US011686055B2

(12) United States Patent
Aveline et al.

(10) Patent No.: US 11,686,055 B2
(45) Date of Patent: Jun. 27, 2023

(54) SHEATH FOR A STRUCTURAL CABLE OF A CONSTRUCTION WORK, METHODS OF INSTALLATION AND MAINTENANCE

(71) Applicant: SOLETANCHE FREYSSINET, Rueil Malmaison (FR)

(72) Inventors: Gautier Aveline, Paris (FR); Matthieu Guesdon, Puteaux (FR); Nicolas Fabry, Antony (FR); Ivica Zivanovic, Gouvieux (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 425 days.

(21) Appl. No.: 16/760,871

(22) PCT Filed: Nov. 3, 2017

(86) PCT No.: PCT/IB2017/001514
§ 371 (c)(1),
(2) Date: Apr. 30, 2020

(87) PCT Pub. No.: WO2019/086923
PCT Pub. Date: May 9, 2019

(65) Prior Publication Data

US 2021/0172116 A1 Jun. 10, 2021

(51) Int. Cl.
*E01D 19/16* (2006.01)
*E04C 5/12* (2006.01)
(Continued)

(52) U.S. Cl.
CPC ..... *E01D 19/16* (2013.01); *D07B 1/16* (2013.01); *E04C 5/12* (2013.01);
(Continued)

(58) Field of Classification Search
CPC ... E04C 5/08; E04C 5/12; E01D 19/14; E01D 19/16; E04G 21/12
See application file for complete search history.

(56) References Cited

U.S. PATENT DOCUMENTS 4,569,708 A * 2/1986 Tanaka ..... D07B 1/162 428/375
4,612,680 A 9/1986 Daiguji
(Continued)

FOREIGN PATENT DOCUMENTS

CN 204199176 U 3/2015
DE 2425866 A1 12/1975
(Continued)

*Primary Examiner* — Christine T Cajilig
(74) *Attorney, Agent, or Firm* — Dentons US LLP

(57) ABSTRACT

The proposed sheath is for a structural cable (10) having a path between an upper anchorage (16) and a lower anchorage (17). It comprises sheath segments (21) assembled along the path of the structural cable, at least one supporting rope (30) extending along the sheath segments and having an upper end connected to the construction work adjacent to the upper anchorage, and connectors (32) for connecting the sheath segments to the at least one supporting rope. The connectors (32) are configured to block relative upward movement of the supporting rope (30) with respect to the sheath segments (21) and to allow relative downward movement of the supporting rope with respect to the sheath segments.

22 Claims, 9 Drawing Sheets

(51) Int. Cl.

| | |
|---|---|
| ***E01D 19/14*** | (2006.01) |
| ***E04C 5/08*** | (2006.01) |
| ***E04G 21/12*** | (2006.01) |
| ***D07B 1/16*** | (2006.01) |

(52) U.S. Cl.
CPC ..... *D07B 2201/2091* (2013.01); *D07B 2501/203* (2013.01); *E01D 19/14* (2013.01); *E04C 5/08* (2013.01); *E04G 21/12* (2013.01)

(56) References Cited

U.S. PATENT DOCUMENTS

| | | | | |
|---|---|---|---|---|
| 5,461,743 | A | 10/1995 | Stubler et al. | |
| 5,479,671 | A * | 1/1996 | Stabler | E01D 19/16 14/74 |
| 5,803,641 | A * | 9/1998 | Nutzel | E04C 5/10 403/45 |
| 7,779,499 | B2 * | 8/2010 | Lecinq | E04G 21/12 52/223.13 |
| 2004/0037080 | A1 | 2/2004 | Luk et al. | |
| 2006/0051035 | A1 * | 3/2006 | Cavill | F16L 59/024 385/100 |
| 2012/0058338 | A1 | 3/2012 | Fyfe et al. | |

FOREIGN PATENT DOCUMENTS

| | | | | |
|---|---|---|---|---|
| DE | 3403611 | A1 | 8/1985 | |
| EP | 0169276 | A1 | 1/1986 | |
| FR | 2674555 | A1 * | 10/1992 | E02D 5/765 |
| GB | 2044726 | A | 10/1980 | |
| KR | 1020130014092 | A1 | 2/2013 | |
| WO | 2015063511 | A1 | 5/2015 | |
| WO | 2018020288 | A1 | 2/2018 | |
| WO | 2018020289 | A1 | 2/2018 | |
| WO | 2018130271 | A1 | 7/2018 | |

* cited by examiner

FIG. 4
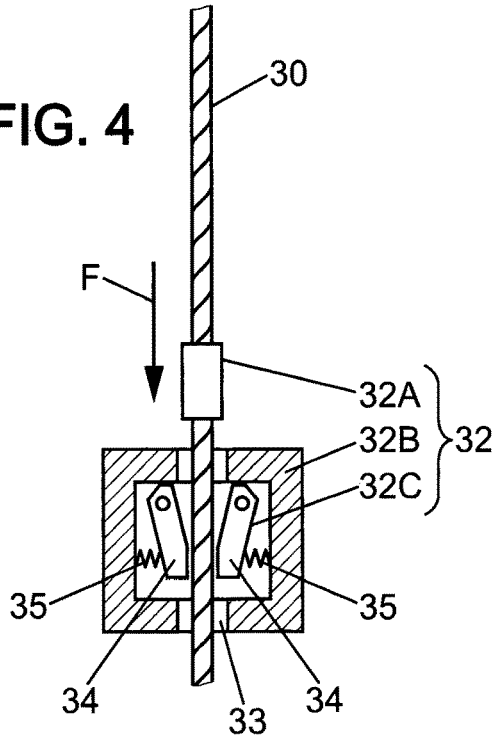
FIG. 5
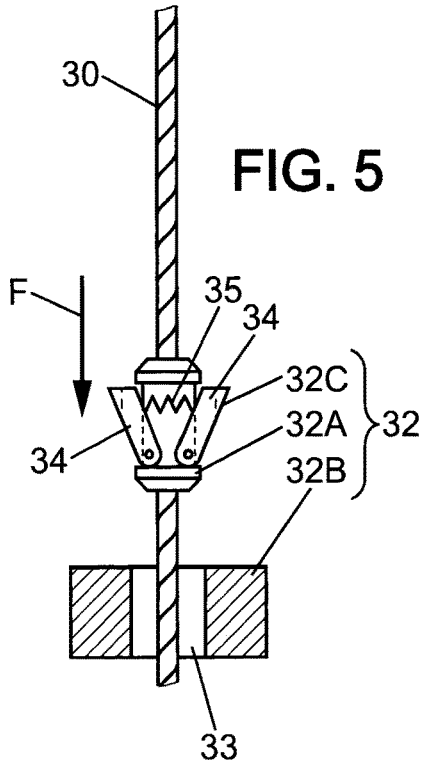
FIG. 6
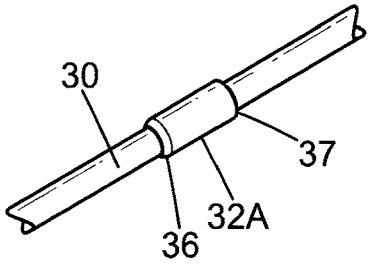
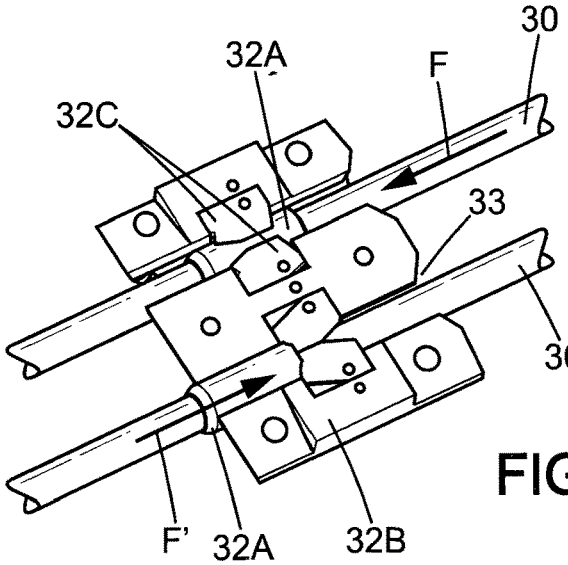
FIG. 7

SHEATH FOR A STRUCTURAL CABLE OF A CONSTRUCTION WORK, METHODS OF INSTALLATION AND MAINTENANCE

This application is a National Stage filing under 35 U.S.C. 371 of International Application No. PCT/IB2017/001514 filed Nov. 3, 2017, which is hereby incorporated by reference in its entirety for all purposes as if fully set forth herein.

The present invention relates to structural cables used in the construction industry. It is applicable, in particular, to stay cables used for supporting, stiffening or stabilizing structures.

BACKGROUND

Stay cables are widely used to support suspended structures such as bridge decks or roofs. They can also be used to stabilize erected structures such as towers or masts.

A typical structure of a stay cable includes a bundle of tendons, for example wires or strands, housed in a collective plastic sheath. The sheath protects the metallic tendons of the bundle and provides a smooth appearance of the stay cable.

In certain cases, the sheath is in the form of a continuous, integral tube which extends from the lower anchoring point to the upper anchoring point of the stay cable. The tendons are threaded, usually one by one or small groups by small groups, into the sheath before anchoring them at both ends. Examples illustrating such technology are described in U.S. Pat. Nos. 5,461,743 and 7,779,499.

In other cases, the sheath is made of segments following each other along the cable. Each segment can be made of several sectors assembled around the bundle of tendons.

U.S. Pat. No. 5,479,671 illustrates the latter kind of technology. It discloses a sheath made of segments supported by a rope running parallel to the load-bearing tendons of the stay cable. The sheath segments are supported independently of each other by the rope, i.e. no segment carries the weight of the segment(s) located above it. Such independence between the sheath segments is needed due to the large difference between the thermal expansion coefficients of the materials of which the tendons and the sheath are made. By attaching each sheath segment at a point of the supporting rope (and thus to the tendons since the thermal expansion coefficients of the ropes and the tendons are similar), elongations due to temperature variations are kept homogeneous between the segments. It results in reduced friction wear and fewer risks of exposing the tendons. The sheath segments are installed after the load-bearing tendons are anchored. The sheath segments are made of several sectors that are put around the bundle of tendons at the lower part of the stay and assembled along longitudinal joints. After a segment is assembled, it is attached to the supporting rope by means of fasteners operated from the outside of the sheath, and the supporting rope is pulled up to clear the space for installing the next sheath segment. After all the segments have been installed, the supporting rope is fixed near the upper anchorage of the cable.

Some construction works make use of very long and/or very inclined (e.g. close to vertical) structural cables, leading to a number of challenges:

- continuous sheaths cannot support their own weight;
- the relative elongations due to the difference in the thermal expansion coefficients may cause an excessive displacement at the top of the sheath;
- the area needed for pre-fabricating or assembling the sheath may become too large;

- handling of the sheath become complex and risky, in particular when it is lifted in windy environments.

While some of these challenges are addressed by the technology disclosed in U.S. Pat. No. 5,479,671, the situation could be improved. In addition, the technology has limitations since it cannot be used if the tendons are not installed before the sheath. Also, it is not advantageous that the fasteners remain visible outside of the sheath and may cause water to leak into the sheath.

An object of the present invention is to propose another kind of sheath design for structural cables.

A further object is to propose a sheath design that is well suited for very long structural cables, and/or very inclined structural cables (e.g. close to vertical).

Still a further object is to propose a process for installing long and/or very inclined structural cable.

Still a further object is that, if needed, members supporting the sheath can be made replaceable during the lifetime of the construction work.

SUMMARY

Part or all of the above-mentioned objects are addressed by providing a sheath for a structural cable of a construction work, the structural cable having a path between an upper anchorage and a lower anchorage. The sheath comprises:

sheath segments assembled along the path of the structural cable;

at least one supporting rope extending along the sheath segments and having an upper end connected to the construction work adjacent to the upper anchorage; and connectors for connecting the sheath segments to the at least one supporting rope.

The connectors are configured to block relative upward movement of the at least one supporting rope with respect to the sheath segments and to allow relative downward movement of the at least one supporting rope with respect to the sheath segments.

The sheath segments can be caused to travel upwards along the supporting rope, especially when the sheath is being installed, while they are maintained in their prescribed positions by the connectors during use. The supporting rope(s) and the connectors can be used to lift the sheath segments or to provide abutments for holding them at discrete positions when they are lifted by some other means. If a supporting rope needs to be replaced for maintenance, it can be pulled down while bringing a new supported rope coupled to its upper end.

The at least one supporting rope and the connectors may be located fully inside the sheath segments.

In an embodiment, the sheath segments are connected to the at least one supporting rope independently of each other by the connectors. Accordingly, a sheath segment does not have to bear the weight of the other sheath segments located above it.

A way of connecting first and second sheath segments independently of each other consists in providing a telescopic coupling between the first sheath segment and the second sheath segment assembled next to the first sheath segment along the path of the structural cable. The telescopic coupling comprises a first sleeve portion belonging to the first sheath segment and a second sleeve portion belonging to the second sheath segment and inserted into the first sleeve portion. At least one of the connectors may have a connector part secured to the first sheath segment at an inner surface of the first sleeve portion so as to receive a respective supporting rope.

In particular, a plurality of the connectors may have respective connector parts mounted on a collar fixed inside the first sleeve portion so as to receive a respective supporting rope extending through the first and second sheath segments.

To have a smooth aspect of the sheath, the first sleeve portion may have a same outer cross-section as main portions of the first and second sheath segments.

In an embodiment, each of the sheath segments has a duct in which at least one longitudinal channel is formed for housing the at least one supporting rope, the channel being separated by a wall from a main space of the duct provided for receiving load-bearing tendons of the structural cable.

If at least one supporting rope housed in the channel has connector parts of the connectors secured thereto at discrete locations, the channel is conveniently designed with a cross-section sufficient for allowing longitudinal movement of the connector parts secured to the supporting rope housed therein.

If a telescopic coupling is provided between a first sheath segment and a second sheath segment assembled next to the first sheath segment along the path of the structural cable, the telescopic coupling comprising a first sleeve portion belonging to the first sheath segment as an extension of the duct of the first sheath segment and a second sleeve portion belonging to the second sheath segment as an extension of the duct of the second sheath segment and inserted into the first sleeve portion, the channel formed in the duct of the second sheath segment may be extended in the second sleeve portion in alignment with the channel formed in the duct of the first sheath segment.

In an embodiment of the sheath, each of the connectors has a first connector part secured to a supporting rope, a second connector part secured to a sheath segment and a third connector part configured to block relative upward movement of the first connector part with respect to the second connector part and to allow relative downward movement of the first connector part with respect to the second connector part.

Another aspect of the present disclosure relates to a structural cable of a construction work, comprising:

an upper anchorage;

a lower anchorage;

load-bearing tendons extending along a path of the structural cable between the upper and lower anchorages; and a sheath as defined above, in which the load-bearing tendons are housed.

Another aspect of the present disclosure relates to a method of installing a sheath for a structural cable of a construction work, the structural cable having a path between an upper anchorage and a lower anchorage, the sheath having a number N of sheath segments ($N \geq 2$). The method of installing the sheath comprises:

mounting at least one supporting rope with an upper end adjacent to the upper anchorage; and for each integer n such that $1 \leq n \leq N$:

inserting the at least one supporting rope into the n-th sheath segment;

connecting the n-th first sheath segment to a supporting rope; and lifting the first to n-th sheath segments along the at least one supporting rope.

Connectors are provided to block relative upward movement of the at least one supporting rope with respect to the sheath segments and to allow relative downward movement of the at least one supporting rope with respect to the sheath segments.

In an embodiment of the method, each supporting rope has first connector parts secured thereto at discrete locations, and each sheath segment has at least one second connector part secured thereto. Each of the connectors is formed by associating a first connector part secured to a supporting rope, a second connector part secured to a sheath segment and a third connector part configured to block relative upward movement of the first connector part with respect to the second connector part and to allow relative downward movement of the first connector part with respect to the second connector part.

Connecting the n-th first sheath segment to a supporting rope for an integer n such that $1 \leq n \leq N$ may comprise forming at least one connector (by associating a first connector part secured at a lowermost discrete location of a respective supporting rope, a second connector part secured to the n-th sheath segment and a third connector part.

Lifting the sheath segments for an integer n such that $1 < n \leq N$ may comprise forming at least n−1 connectors by associating, for each integer j such that $1 < j < n$, a first connector part secured to a supporting rope at a (n−j+1)-th discrete location, starting from the lowermost discrete location, a second connector part secured to the j-th sheath segment and a third connector part.

An embodiment of the method comprises, for an integer n such that $1 < n \leq N$:

lowering the supporting rope while preventing downward movement of at least the (n−1)-th sheath segment;

inserting the at least one supporting rope into the n-th sheath segment;

forming an n-th connector by associating the first connector part secured at the lowermost discrete location of the supporting rope, a second connector part secured to the n-th sheath segment and a third connector part; and pulling back up the supporting rope, thereby forming the at least n−1 connectors.

Supporting ropes mounted with respective upper ends adjacent to the upper anchorage may comprise:

an active rope that is lowered and pulled back up; and a static rope used to prevent downward movement of the sheath segments when the active rope is lowered and pulled back up.

In such an embodiment, the sheath segments have second connector parts arranged to form connectors with first connector parts secured to the active rope and additional second connector parts arranged to form connectors with first connector parts secured to the static rope.

Assembling the sheath segments before installation of the load-bearing tendons makes it possible to use sheath segments having an integral cross-section. It may then be appropriate to hold the (n−1)-th sheath segment to restrict lateral movements thereof while inserting the at least one supporting rope into the n-th sheath segment and forming the n-th connector, for each integer n such that $1 < n \leq N$. In addition, it may be appropriate to tension at least one supporting rope to restrict lateral movements of the sheath segments while lifting the first to n-th sheath segments.

Another aspect of the present disclosure relates to a maintenance method for a structural cable of a construction work, the structural cable comprising:

an upper anchorage;

a lower anchorage;

load-bearing tendons extending along a path of the structural cable between the upper and lower anchorages; and a sheath in which the load-bearing tendons are housed.

In that maintenance method, the sheath comprises:

sheath segments assembled around the load-bearing tendons along the path of the structural cable;

at least two supporting ropes extending along the sheath segments, each having an upper end connected to the construction work adjacent to the upper anchorage; and connectors for connecting the sheath segments to the at least one supporting rope.

The connectors are arranged to block relative upward movement of the at least one supporting rope with respect to the sheath segments and to allow relative downward movement of the at least one supporting rope with respect to the sheath segments.

The maintenance method comprises replacing a first one of the supporting ropes by a second supporting rope while the assembled sheath segments are supported by at least another one of the supporting ropes. Replacing the first supporting rope by the second supporting rope comprises:

disconnecting the upper end of the first supporting rope;

coupling a lower end of the second supporting rope to the upper end of the first supporting rope;

pulling a lower end the first supporting rope to remove the first supporting rope while installing the second supporting rope; and connecting an upper end of the second supporting rope adjacent to the upper anchorage.

In an embodiment of the maintenance method, each of the first and second supporting ropes has first connector parts secured thereto at discrete locations, and each sheath segment has second connector parts secured thereto. Before replacing the first supporting rope by the second supporting rope, connectors are formed by associating a first connector part secured to the first supporting rope, a second connector part secured to a sheath segment and a third connector part configured to block relative upward movement of the first connector part with respect to the second connector part and to allow relative downward movement of the first connector part with respect to the second connector part. After replacing the first supporting rope by the second supporting rope, new connectors are formed by associating a first connector part secured to the second supporting rope, a second connector part secured to a sheath segment and a third connector part configured to block relative upward movement of the first connector part with respect to the second connector part and to allow relative downward movement of the first connector part with respect to the second connector part. The first connector parts secured to the first and second supporting ropes travel through the second connector parts secured to the sheath segments when the lower end of the first supporting rope is pulled downward for replacing the first supporting rope by the second supporting rope.

BRIEF DESCRIPTION THE DRAWINGS

Other features and advantages of the invention disclosed herein will become apparent from the following description of non-limiting embodiments, with reference to the appended drawings, in which:

FIGS. 4 and 5 are sectional schematic views of particular embodiments of connectors usable in some sheath arrangements;

FIGS. 6 and 7 are perspective schematic views showing cooperating parts of such connectors;

DESCRIPTION OF EMBODIMENTS

Figure 1:
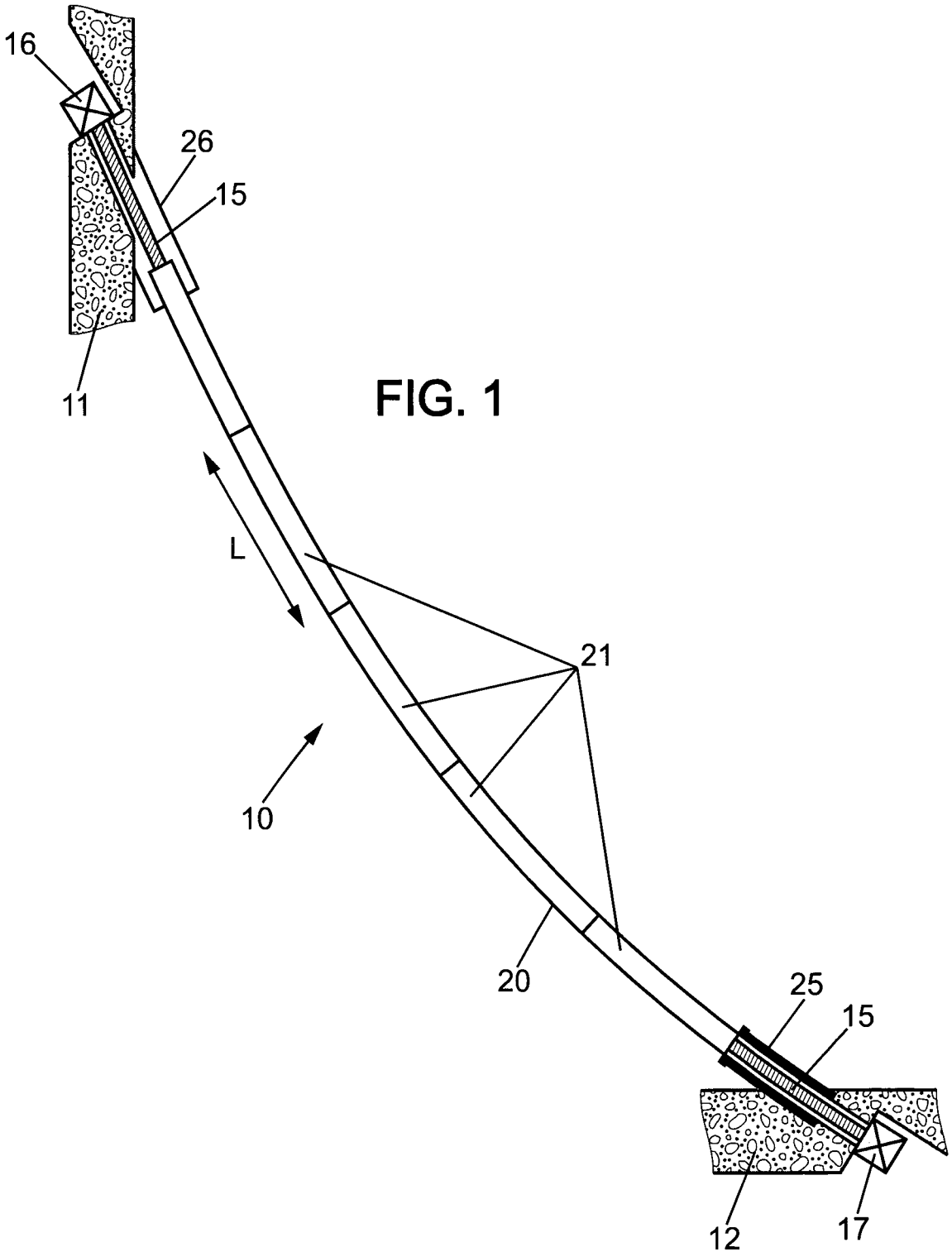
FIGS. 1 and 2 are schematic side views of a stay cable.

FIG. 1 shows a stay cable 10 which is a structural cable extending between two parts 11, 12 of a construction work. The first part 11 is at a higher position than the second part 12. For example, the first part 11 belongs to a tower, while the second part 12 belongs to a foundation to stabilize the tower. Alternatively, the first part 11 may belong to a pylon, while the second part 12 belongs to some structure suspended from the pylon 11.

The construction work typically includes a number of stay cables 10, only one of them being shown in FIG. 1.

The structural cable 10 has a load-bearing part 15 which consists of a bundle of tendons disposed parallel to each other. For example, the load-bearing tendons may be strands of the same type as used to pre-stress concrete structures. Each strand may optionally be protected by a substance such as grease or wax and individually contained in a respective plastic sheath (not shown).

Each stay cable 10 may have a length of up to several hundred meters, and include a few tens of tendons.

The load-bearing tendons are anchored at both ends of the bundle 15 using an upper anchoring device 16 mounted on the first part 11 of the construction work and a lower anchoring device 17 mounted on the second part 12 of the construction work. Between the two anchoring devices 16, 17, the bundle of tendons 15 follows a catenary curve due to its own weight and the tensile force maintained by the anchoring devices. The anchoring devices 16, 17 are positioned on the first and second parts 11, 12 by taking into account the pre-calculated catenary curve of each stay cable 10, that defines its path.

The bundle of tendons 15 is contained in a protective sheath 20 typically made of plastic or metallic material.

To ensure good dynamic properties of the stay cable 10, it may be useful to give the sheath 20 a regular profile, typically with a circular cross-section. The sheath 20 may also be provided with specific surface structure, known in the art, e.g. double helical ribs, to improve its behavior in the presence of a combined action of rain and wind.

The sheath 20 is made of a plurality of segments 21 assembled along the path of the structural cable 10. The length of each sheath segment 21 is selected as a function of the design of the stay cable structure. It is possible to use segments 21 having a nominal length L, e.g. of the order of 10 to 100 m or more, for building different stay cables 10 of the construction work. One of the segments can then be cut depending on the length of the particular stay cable. Alternatively, the length L of the different segments of a given stay cable can be selected according to the total length set for the stay cable.

In the example illustrated in FIG. 1, the lower end of the sheath 20 is adjacent to the upper end of a guide tube 25 through which the bundle of tendons 15 passes near the lower anchoring device 17. The upper end of the sheath 20 penetrates into another tube 26 disposed on the first part 11 of the construction work, through which the upper end of the bundle of tendons 15 passes to reach the upper anchoring device 16. The second end of the first sheath 20 is not connected to the tube 26, so that it can slide therein when the tendons 15 and the upper sheath segment 21 undergo different expansion or contraction on account of the thermal expansion coefficients of their materials. The arrangement prevents run off water from flowing inside the upper sheath segment 21.

Figure 2:
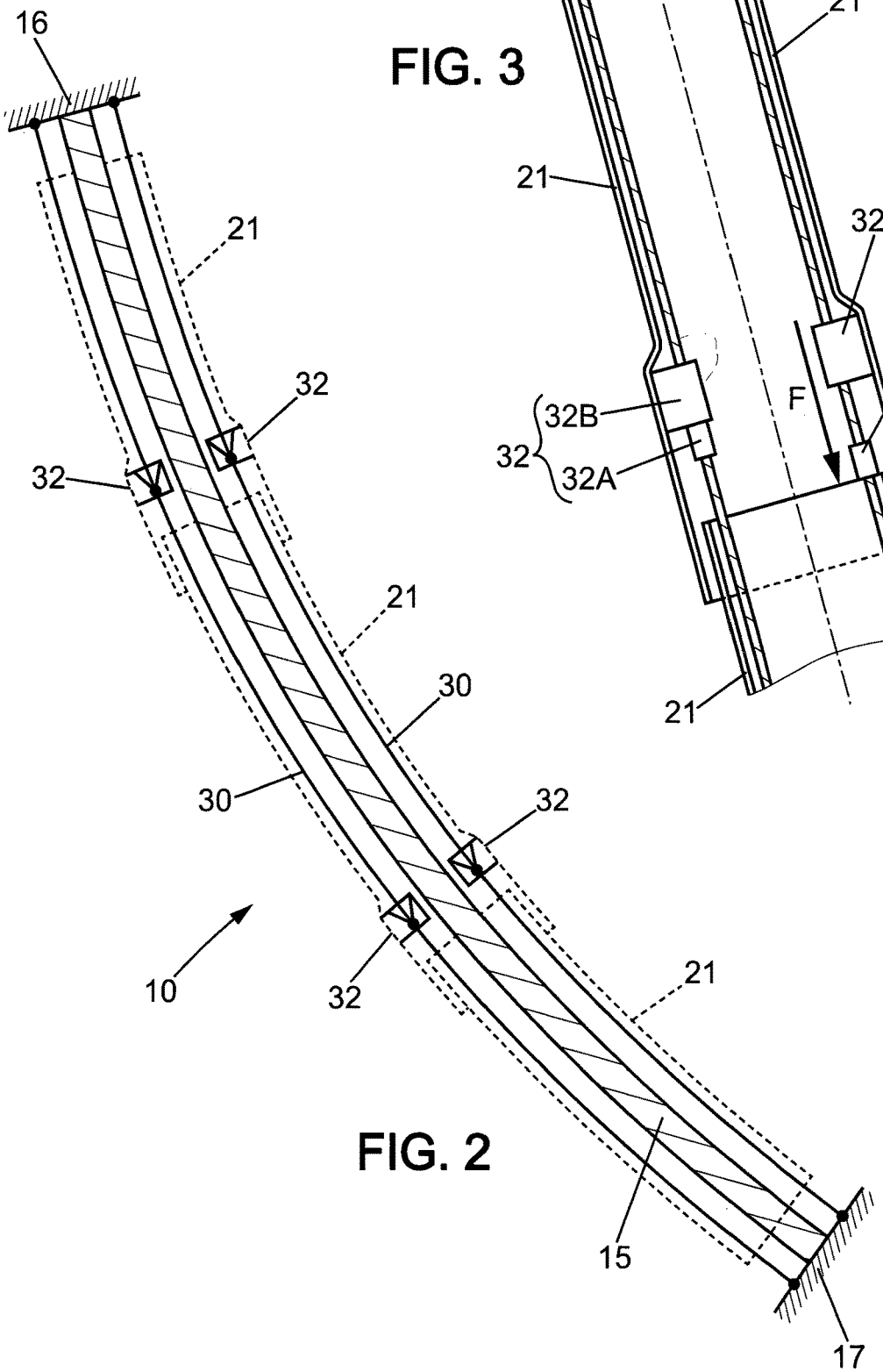

The weight of the plastic sheath 20 is taken up by one or more supporting ropes 30 which are shown in the diagram of FIG. 2 where the lateral dimensions of the stay cable 10 are exaggerated to show more clearly how the sheath segments 21 (shown with broken lines) are suspended.

Each supporting rope may be made of stainless steel. It extends along the series of sheath segments 21, and has an upper end connected to the construction work at or near the upper anchorage 16 where the loadbearing tendons 15 are anchored.

In an exemplary configuration discussed here, the supporting ropes 30 are located inside the sheath segments 21, as well as connectors 32 shown diagrammatically in FIG. 2.

Each connector 32 forms the interface between a respective rope 30 and a respective sheath segment 21. It is configured to block relative upward movement of the rope 30 with respect to the sheath segment 21 and to allow relative downward movement of the rope 30 with respect to the sheath segment 21. The connector 32 may also be made of stainless steel.

The sheath segments 21 are connected to the supporting rope 30 independently of each other by the connectors 32. By way of example, each 100 m segment may be submitted to a compression effort lower than 2.0 MPa.

Figure 3:
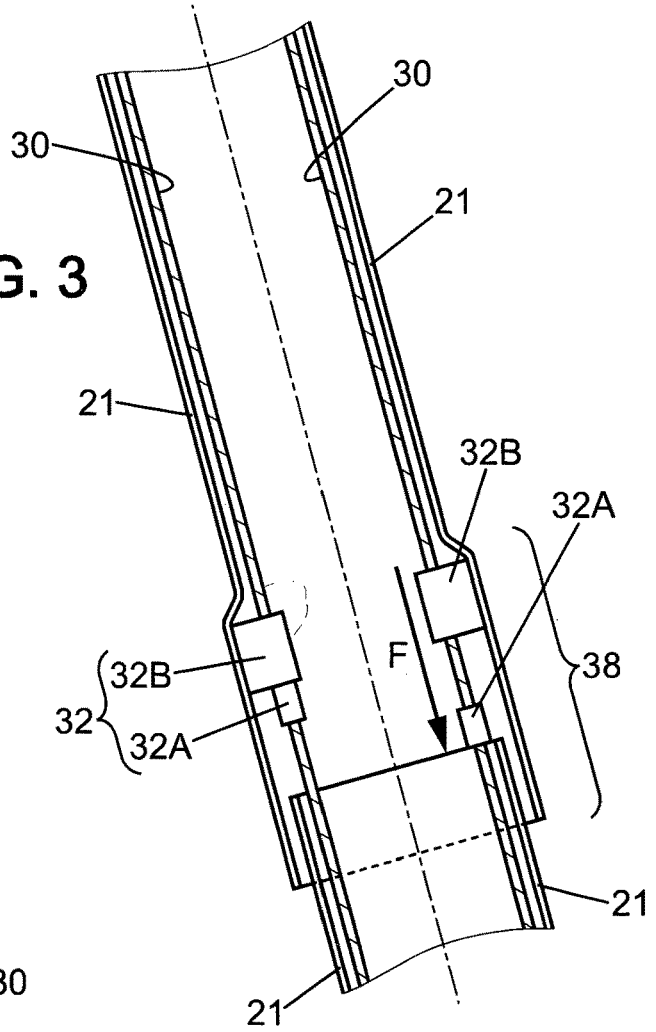
FIG. 3 is a sectional schematic view of a possible arrangement of connectors between sheath segments and supporting ropes.

In the example shown in FIG. 3, each connector 32 has a first part 32A secured to a supporting rope 30 and a second part 32B secured to a sheath segment 21.

When the sheath 20 is assembled, the second connector part 32B is in abutment against the first connector part 32A, so that the sheath segment 21 to which the second connector part 32B is secured is supported by the rope 30, as shown on the left-hand side of FIG. 3.

However, as shown on the right-hand side of FIG. 3 (arrow F), the second connector part 32B does not prevent downward movement of the first connector part 32A secured to the supporting rope 30. The first connector part 32A is also allowed to travel downward through the second connector part 32B.

FIGS. 4 and 5 illustrate possible arrangements of connectors 32 that have such mechanical behavior. In those examples, the first connector part 32A is a metallic sleeve which is fixed to the supporting rope 30, for example by swaging, while the second connector part 32B secured to the sheath segment 21 has a through hole 33 receiving the supporting rope 30. The cross-section of the through hole 33 is large enough to let the supporting rope 30 and the first connector parts 32A travel through it. In order to block relative upward movement of the rope 30 with respect to the sheath segment 21, the connector 32 includes a third connector part 32C that is mounted on one of the first and second parts 32A, 32B to interact with the other one of the first and second parts 32A, 32B.

Different arrangements of the third connector parts 32C are possible. In the example shown in FIG. 4, the third connector part 32C includes a pair of pawl members 34 articulated near the top of the second connector part 32B and pushed towards the supporting rope 30 by springs 35 near the bottom of the second connector part 32B. When the supporting rope 30 moves down with respect to the sheath segment 21 (or the segment 21 moves up with respect to the rope 30) and the first connector part 32A reaches the second connector part 32B, the first connector part 32A pushes the pawl members 34 outwardly against the springs 35 so that it can travel further down as shown by the arrow F. On the other hand, when the first connector part 32A reaches the second connector part 32B from its bottom side, the end surfaces of the pawl members 34 provide an abutment that locks the supporting rope 30 which is thus prevented from traveling further up (arrow F' in FIG. 7).

FIG. 5 illustrates an alternative arrangement of the connector 32, in which the pawl members 34 forming the third connector part 32C are articulated on the first connector part 32A secured to the supporting rope 30. One or more springs 35 push outward the top end of the pawl members 34. When the supporting rope 30 moves down with respect to the sheath segment 21 and the first connector part 32A reaches the second connector part 32B, the second connector part 32B pushes the pawl members 34 inwardly against the springs 35 so that it can travel further down as shown by the arrow F. On the other hand, when the first connector part 32A reaches the second connector part 32B from its bottom side, the end surfaces of the pawl members 34 are spread out and provide an abutment that locks the supporting rope 30 which is thus prevented from traveling further up.

FIGS. 6 and 7 illustrate connector parts in an arrangement as shown diagrammatically in FIG. 4. The swaged first connector part 32A can have a beveled lower surface 36 to facilitate its penetration into the through hole 33 when the supporting rope 30 travels downward and reaches the second connector part 32B, and a straight upper surface 37 for abutment on the pawl members 34 forming the third connector part 32C.

It will be appreciated that many other connector arrangements providing the required functionality can be considered. It is possible, in some particular embodiments, that the connector 32 does not have any part secured to the supporting rope 30. For example, locking the supporting rope 30 against relative upward movement with respect to a sheath segment 21 can be performed by (conical) jaws interacting with a connector part secured to the sheath segment to lock by a wedge action. Some mechanism may then be needed to unlock the conical jaws when the supporting rope 30 has to travel down with respect to the sheath segments 21.

It may, however, be preferred to provide first connector parts 32A fixed in advance on the supporting ropes 30 at discrete locations. The intervals between the discrete locations correspond to the lengths L of the individual sheath segments 21.

It is advantageous that the connectors 32 have no part protruding out of the sheath 20. This avoids impacting the visual aspect of the stay cable 10. It is also preferable for water tightness of the sheath.

The diagram of FIG. 3 shows a telescopic coupling of two adjacent sheath segments 21. In this example, the lower end of a first sheath segment located above a second sheath segment has a first sleeve portion 38 that is widened in order to receive a second sleeve portion formed by the upper end of the second sheath segment to provide the telescopic coupling. The first and second sleeve portions can have a relative movement along the axis of the cable in order to absorb thermal expansion or contraction of the sheath segments 21. Advantageously, the second connector parts 32B are located in the sleeve portion 38, in its upper region where the cross-section of the sheath segment is widened (see also the diagram of FIG. 2).

FIGS. 8-12 illustrate another embodiment of the telescopic coupling. Here, each sheath segment 21 includes a duct 40 that makes up most of the length of the sheath segment, a lower sleeve portion 41 and an upper sleeve portion 42. The example includes four supporting ropes 30 extending parallel to the load-bearing tendons of the structural cable.

In the embodiment of FIGS. 8-12, the lower sleeve portion 41 of a sheath segment 21 has the same outer cross-section as the main portions (i.e. ducts) 40 of the two adjacent sheath segments, while the upper sleeve portion 42 of the underlying segment 21 has a smaller outer cross-section and is inserted in the sleeve portion 41. Such a sheath design has no bulging part, which may be preferred for aesthetic reasons.

In the example of sheath segments of 100 m, the sleeve portions 41, 42 may be dimensioned to provide a 1.5 m stroke. For HDPE ducts, this is enough to accommodate thermal expansion or contraction in a temperature range of about 80° C.

Two longitudinal channels 48 are formed within the circular inner cross-section of the duct 40. Two of the supporting ropes 30 are housed in each channel 48. It will be observed that this is merely an example. There could be only one channel 48, or more than two channels. There could also be one supporting rope 30 per channel 48, or more than two. A symmetrical configuration of the channels 48 and supporting ropes 30 will generally be preferred to minimize moments when the sheath segments are lifted.

A wall 49 of each channel 48, which may be co-extruded with the duct 40, prevents contacts of the supporting ropes 30 with the load-bearing tendons 15 received in the main space of the duct 40, in order to avoid potential damage of the tendons 15 or their individual sheaths.

In order to allow relative (upward) movements of the sheath segments 21 along the supporting ropes 30, the cross-section of the channel 48 must be sufficient to allow the first connector parts 32A swaged on the ropes 30 to circulate.

Figure 8:
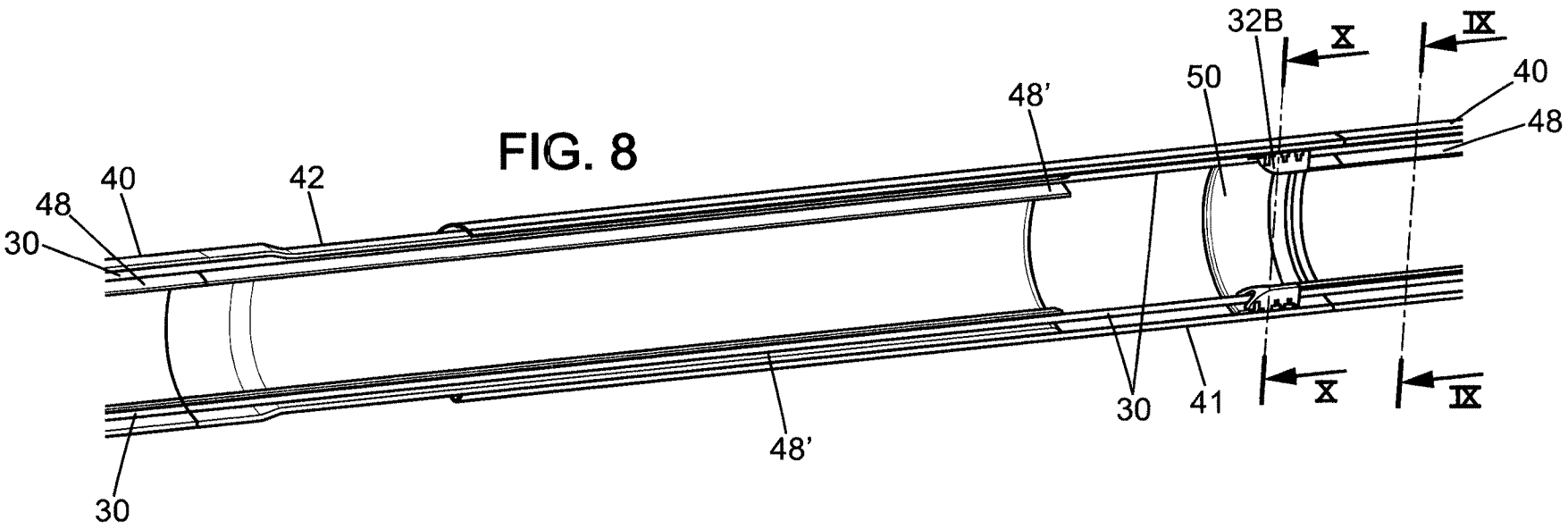
FIG. 8 is a perspective view of assembled sheath segments in an embodiment.
Figure 10:
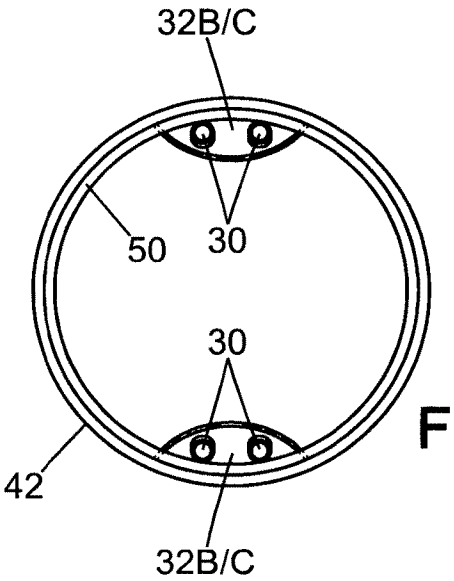
FIGS. 9 and 10 are cross-sectional views of a sheath segment along planes IX-IX and X-X shown in FIG. 8.
Figure 9:
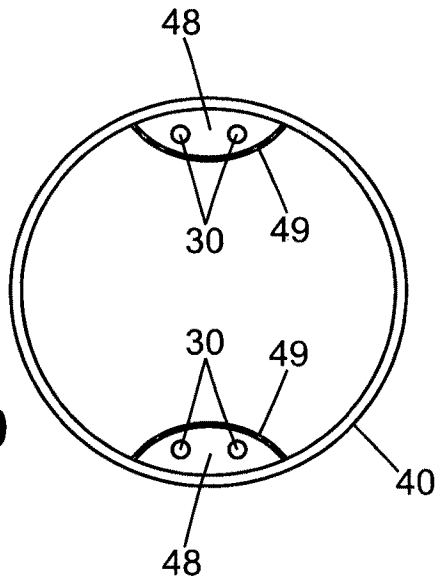
Figure 11:
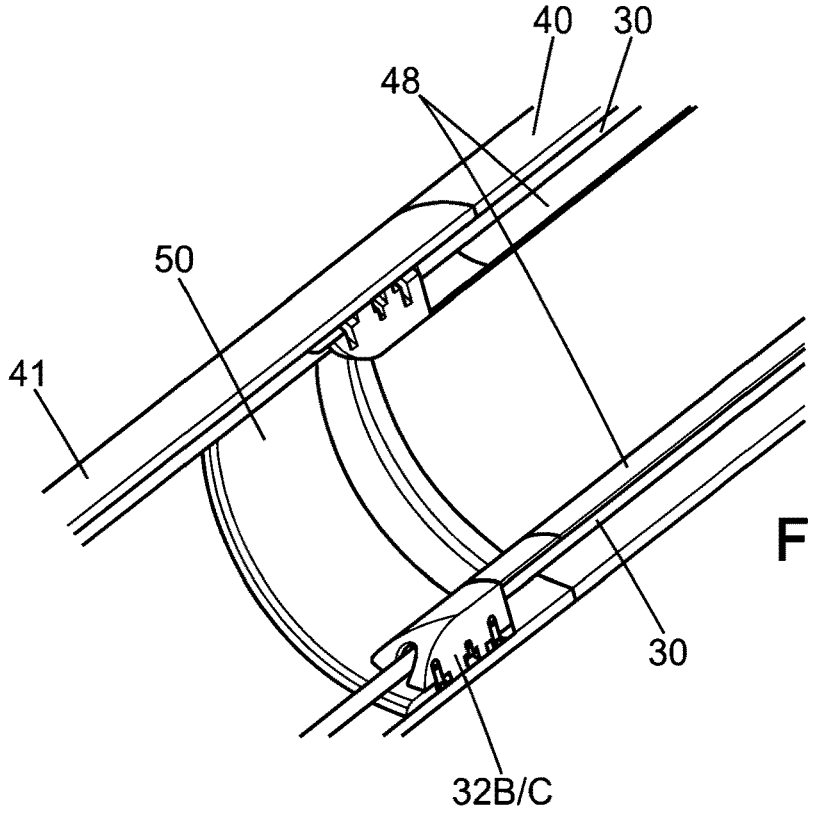
FIGS. 11 and 12 are perspective views showing part of FIG. 8 in more details.
Figure 12:
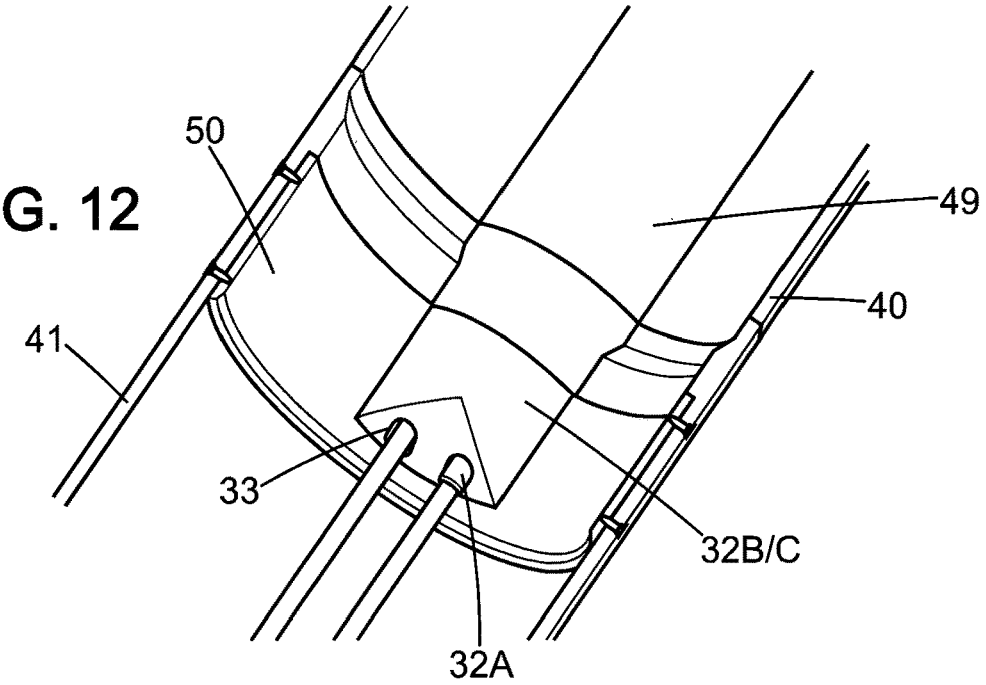
Figure 13:
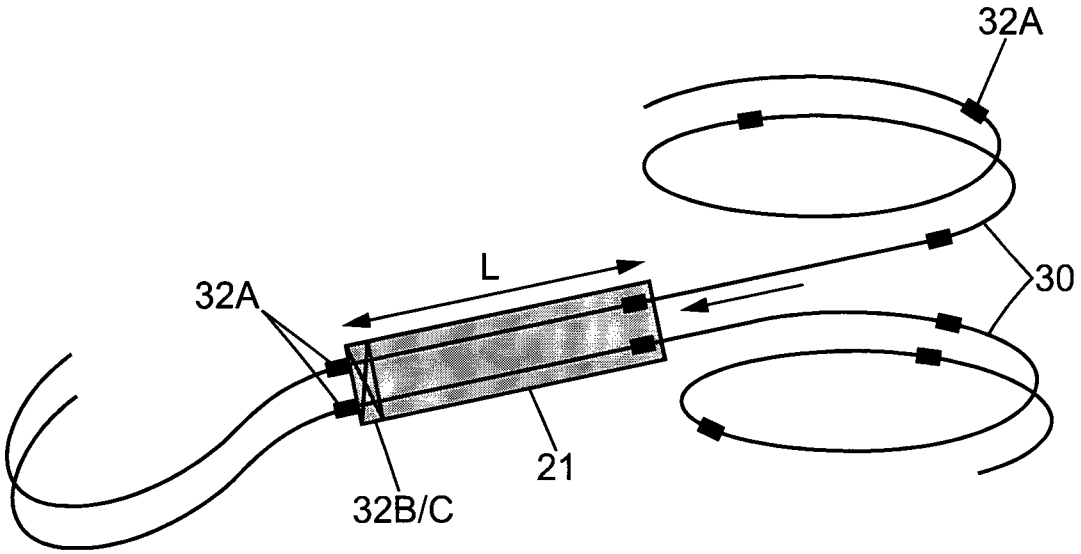
FIGS. 13-17 are diagrams illustrating different steps of an installation method of a cable sheath in an embodiment of the present invention.

As shown by numeral 48' in FIG. 8, the channel 48 formed in the duct 40 of a sheath segment 21 is extended in the upper sleeve portion 42 of the underlying sheath segment 21, in alignment with the channel formed in the duct 40 of the underlying sheath segment. The channel 48 is, however, interrupted in the lower sleeve portion 41 in order to allow the telescopic action of the sleeve portions. In that limited interval, no contacts between the supporting ropes 30 and the load-bearing tendons 15 are possible.

The sheath according to the present invention may incorporate cavities for mounting equipment such as, e.g., light sources, as described in the international patent application No. PCT/IB2017/000214 filed on Feb. 3, 2017 and published as WO 2018/130271 A1. Such cavities may be formed together with the above-mentioned channels 48. It will also be noted that a sheath according to the present invention may have a double-walled structure as disclosed in the international patent applications Nos. PCT/IB2016/001314 filed on Jul. 27, 2016 and published as WO 2018/020288 A1 and PCT/IB2016/001978 filed on Nov. 18, 2016 published as WO 2018/020289 A1.

FIGS. 8 and 10-12 show pawl boxes forming the above-mentioned second connector parts 32B and third connector parts 32C. The pawl boxes 32B/C are secured to the lower sleeve portion 41 of the sheath segment 21 by means of a collar 50. The collar 50 is fixed inside the lower sleeve portion 41, at its upper end. The pawl boxes 32B/C are mounted on the collar 50 so that the through holes 33 described with reference to FIGS. 4-7 are aligned with the channel 48 of the duct 40.

FIGS. 13-18 illustrate an exemplary method for installing a cable sheath 20 of the type described above. In the example, two supporting ropes 30 are shown. It will be appreciated that the number of ropes 30 is not a limitation. For example, if there are four ropes as shown in FIGS. 8-12, they can be operated in pairs with the same method.

In the following description, one of the two supporting ropes 30 is referred to as an active rope 30A, while the other one is referred to as a static rope 30S. When there are two ropes per channel 48 (FIGS. 9-10), one of them can be an active rope while the other is a static rope.

During the installation, static ropes will stay fixed, while the active ropes will make synchronized trips back and forth to grab the sheath segments 21 one by one and lift them together. To do so, during the installation, the static ropes 30S are directly connected to their final upper anchorage (60 in FIG. 18), while the active ropes 30A are connected to a winch 61 which is used to move them back and forth.

Before the lifting operation, the supporting ropes 30 (with their connector parts 32A installed at factory) are inserted inside the first sheath segment 21 by its top side until the lower connector part 32A of each rope goes through the pawl box 32B/C at the other side of the duct 40, thus forming a connector 32. To facilitate threading of the ropes 30 into the through holes 33 of the pawl boxes 32B/C, it is convenient to provide the sheath segments 21 with temporary links extending along the length of the segment and inserted into the through holes 33 and the channels 48 before assembling the lower sleeve portion 41 with the duct 40. When the sheath segment 21 is installed, the end of the temporary link on the upper side of the segment is coupled to the lower end of the supporting rope, and the supporting rope is slid into the channel and the through holes 33 by pulling on the temporary link.

The initial step of mounting the first sheath segment 21 on the supporting ropes 30 (FIG. 13) can be performed on the ground. Then, the upper ends of the supporting ropes 30 are lifted and attached to the upper anchorage 60 (for the static rope(s) 30S) and to the winch 61 (for the active rope(s) 30A).

Figure 14:
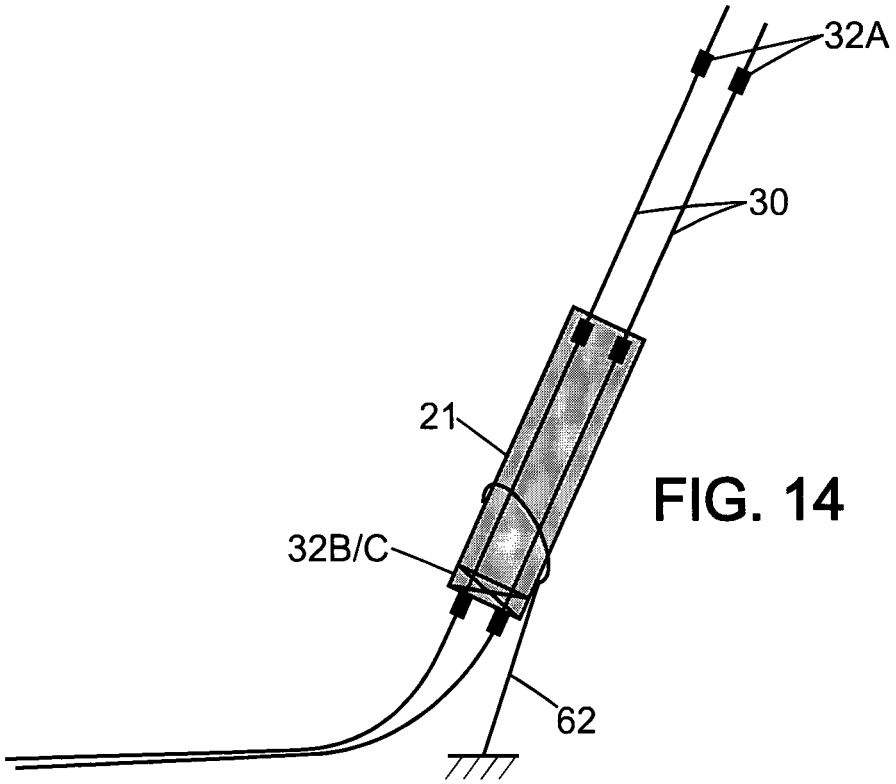
Figure 18:
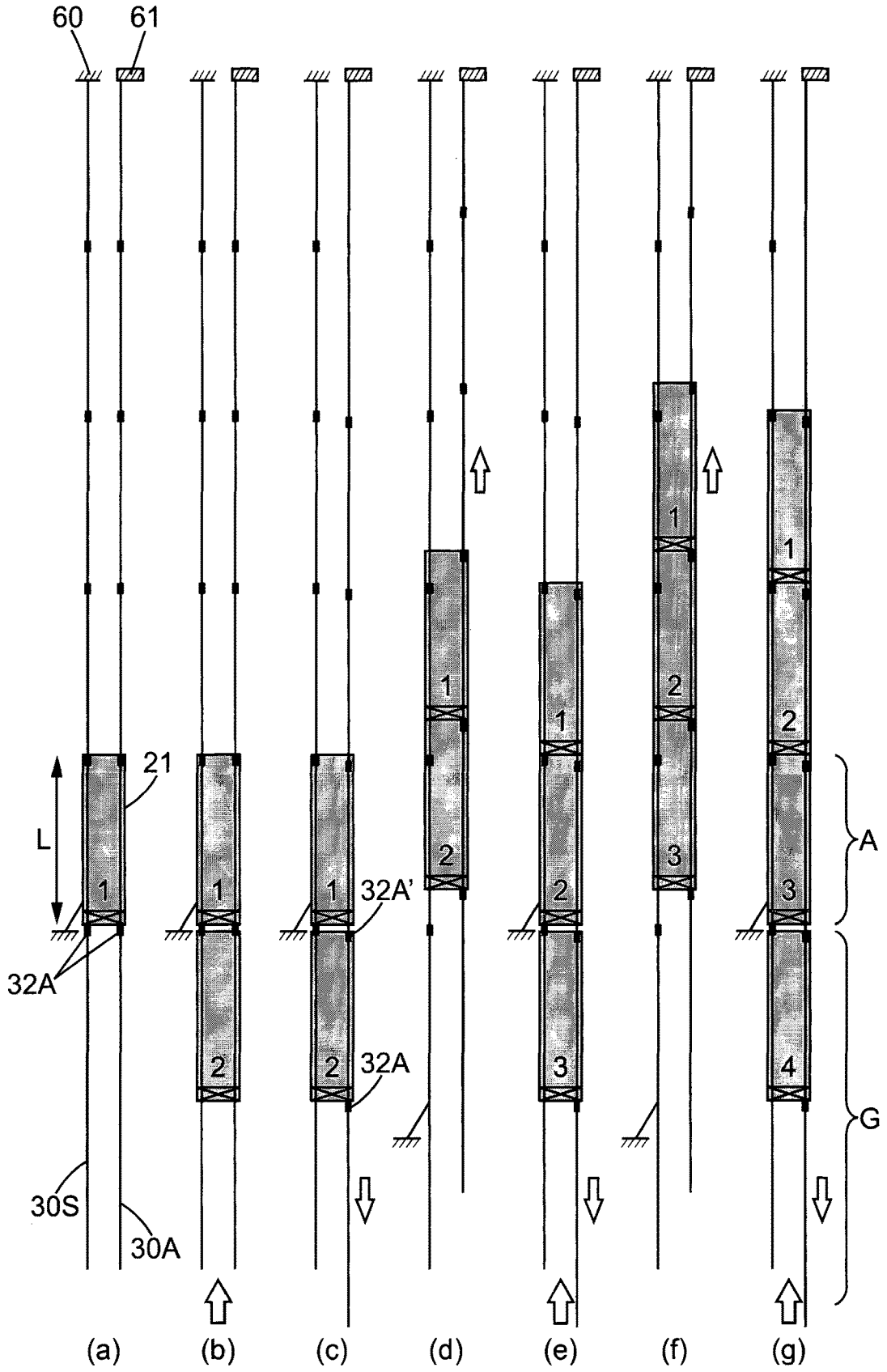
FIG. 18 summarizes installation steps in a single diagram.

At this point, the first sheath segment 21 is also lifted along the ropes 30, with its connectors 32 locked, to the position illustrated in FIGS. 14 and 18(*a*), which is referred to as an assembling position since it is the position where the sheath segments 21 will be successively juxtaposed. The assembling position is noted 'A' in FIG. 18, where 'G' denotes the ground level.

The winch 61 can be operated to reel and unreel the active rope 30A.

In order to withstand the induced catenary force and to ensure secure conditions for installing the sheath 20, even in windy weather conditions, some tension is applied to the supporting ropes 30 by pulling the sheath segment 21 parallel to the direction of the segment at the assembling position A. This can be done, for example, by means of one or more tensioned slings 62 or legs connected to the ground and to a collar or some other means that grabs the bottom part of the sheath segment 21 located at the assembling position A. Pulling down the segment 21 by means of the sling 62 applies tension to the static rope 30 through the engagement of the pawl box 32B/C with the first connector part 32A of the static rope 30S.

It is then possible to bring and assemble the next sheath segments 21 by moving the active rope 30A. In the following, 'N' denotes the number of sheath segments 21 of which the sheath 20 is made. Each of the second to N-th sheath segment 21 can be assembled in the same manner, illustrated in FIGS. 15-17. The steps shown in FIGS. 15-17 for n=2 are readily generalized to any integer n such that $1<n\leq N$.

Figure 15:
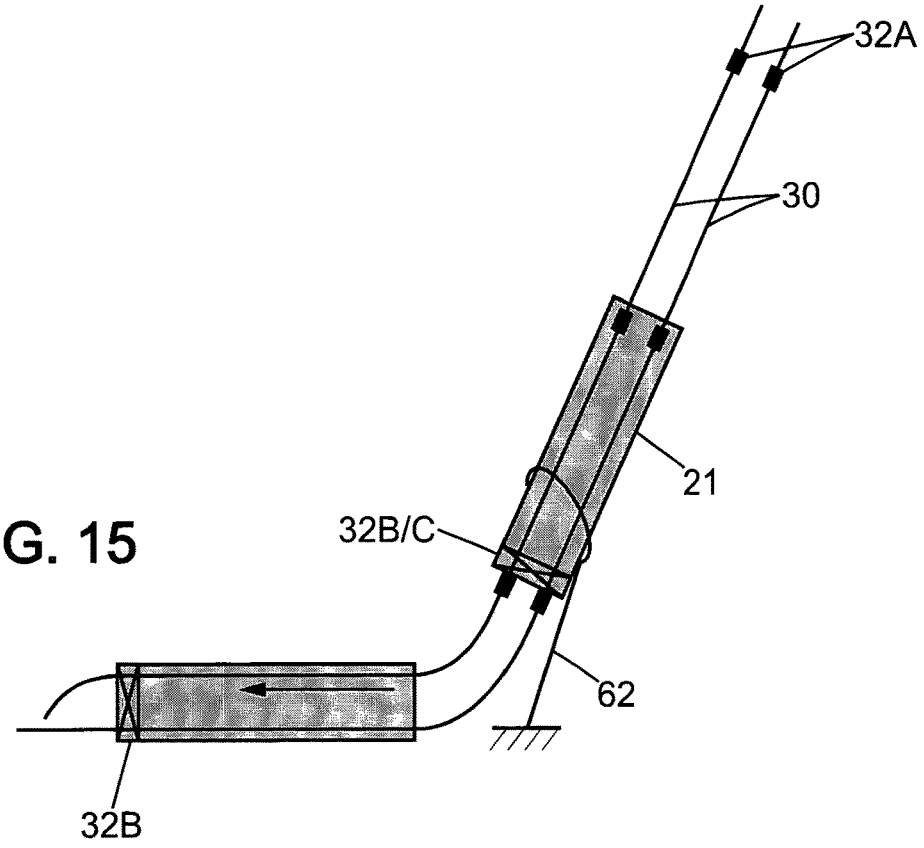
Figure 16:
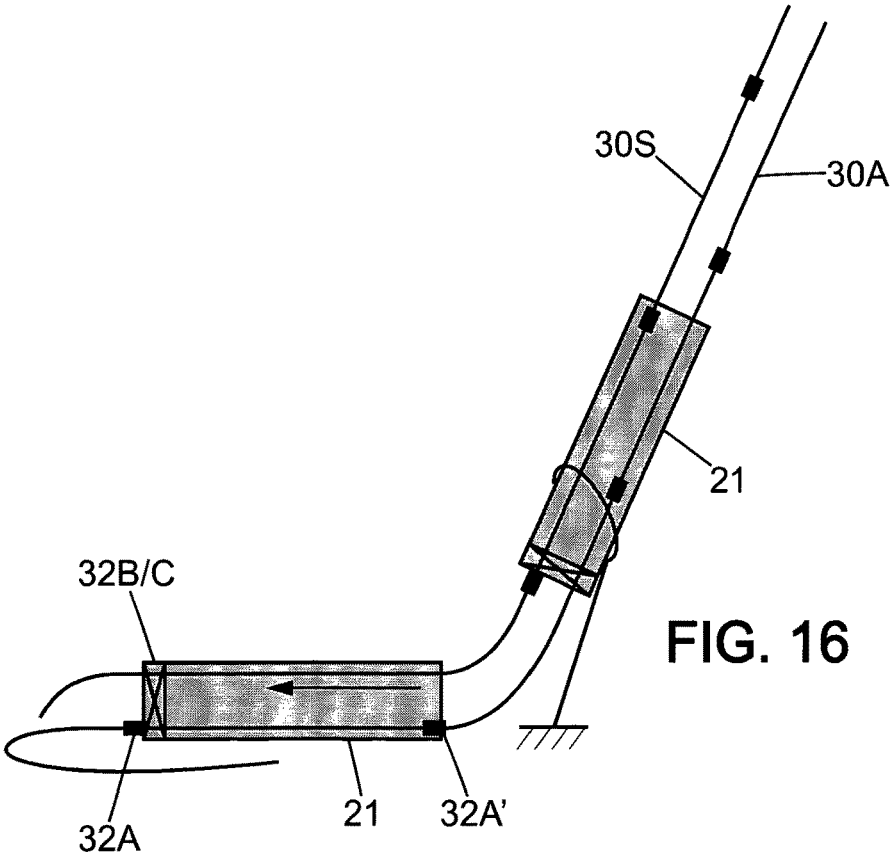

While the (n−1)-th sheath segment 21 is at the assembling position A and pulled by the sling 62, the ground area G is available for inserting the free ends of the supporting ropes 30 into the next (n-th) sheath segment 21 by its top side, for example with the help of temporary links (FIGS. 15 and 18(*b*)). The active rope 30A is unreeled from the winch 61 (and possibly pulled from its lower end) until its first connector part 32A secured at the lowermost discrete location reaches the pawl box 32B/C of the n-th sheath segment 21 (FIGS. 16 and 18(*c*)), which connects the n-th sheath segment 21 to the active rope 30A. During this process, the first connector part 32A' of the active rope 30A, which is at the second discrete location starting from the lowermost one, has also traveled through the pawl box 32B/C of the (n−1)-th sheath segment 21.

Figure 17:
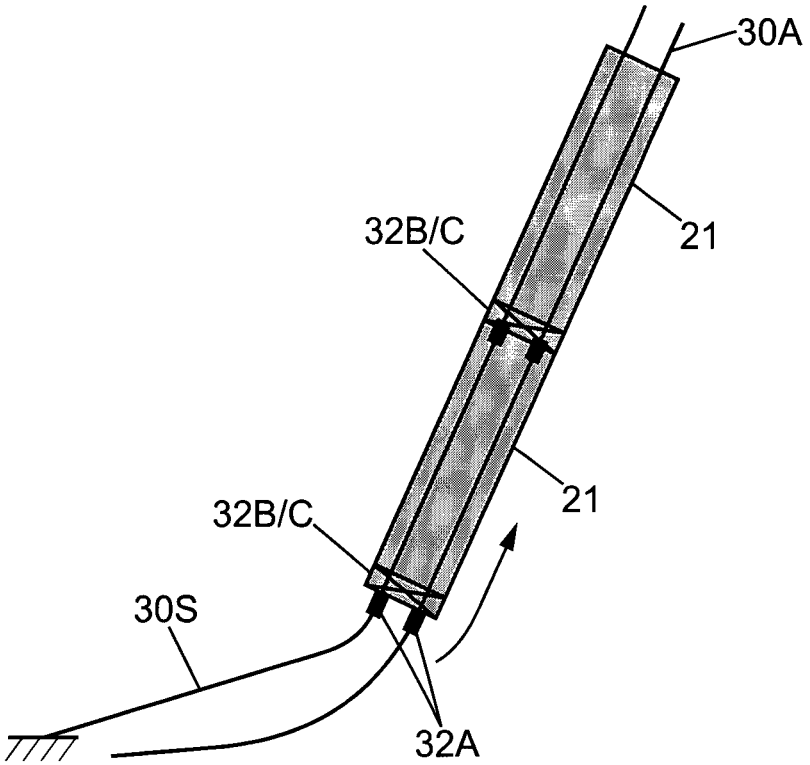

Once a new connector 32 is formed by associating the lowermost first connector part 32A of the active rope 30A with the pawl box 32B/C of the n-th sheath segment 21, the active rope 30A is reeled back up by activating the winch 61. When the connector part 32A' of the active rope 30A reaches the pawl box 32B/C of the (n−1)-th sheath segment 21, that (n−1)-th segment starts moving up, along with the n-th segment. The first to (n−2)-th segments, if n>2, are lifted at the same time, new connectors 32 being formed with each of them. Before that point is reached, the static rope 30S is connected to the ground and the sling 62 is removed, as shown in FIGS. 17 and 18(*d*). The rising movement of the (n−1)-th sheath segment 21 clears the assembling position A which is then occupied by the n-th sheath segment 21.

While the first to (n−1)-th sheath segments 21 are lifted by operating the winch 61, n−1 connectors 32 are formed with the active rope 30A and also with the static rope 30S by associating, for each integer j such that $1<j<n$, a first connector part 32A secured to a rope 30A or 30S at the (n−j+1)-th discrete location and a pawl box 32B/C of the j-th sheath segment 21.

The reeling action of the winch 61 may lift the n-th sheath segment 21 slightly beyond the assembling position A, as shown in FIG. 18(*d*). If this happens, the winch 61 is activated again move down the active rope 30A until the first connector parts 32A of all the ropes 30 are aligned.

FIGS. 18(*e*) and 18(*f*) correspond to FIG. 18(*c*) and FIG. 18(*d*), respectively, for n=3. FIG. 18(*g*) corresponds to FIGS. 18(*c*) and 18(*e*) for n=4. The above-described process is repeated up to the N-th sheath segment 21.

Once all the sheath segments 21 have been installed, the active rope 30A can be fixed in its final position by removing the winch 61 and replacing it by a permanent anchorage 60. In certain cases, the active rope(s) 30 may be used only temporarily, or as a tool to successively install different stay cables of the construction work. In such a case, the active rope 30A may be removed after installation of the N sheath segments 21 by pulling it from its lower end.

In the above-described exemplary embodiment of the installation process, the first to (n−1)-th sheath segments 21 are lifted along the supporting ropes 30, so as to clear the assembling position A, at the same time as the n-th sheath segment 21 is brought to the assembling position A. The lifting and bringing actions are completed simultaneously by means of the active rope 30A. Variations of the method where the two actions are separated can also be considered.

The above-described installation method is suitable when the sheath segments 21 have an integral cross-section. However, other methods are applicable within the scope of the present invention, including methods in which the sheath segments are made of sectors assembled together on site. For example, such sheath segments made of sectors can be assembled around the bundle of load-bearing tendons 15 which has been installed and anchored beforehand (like in U.S. Pat. No. 5,479,671). In such an embodiment, it may be sufficient to use only one supporting rope for independent suspension of the sheath segments.

A nice feature of the above-described sheath arrangement is that it makes it possible to replace one or more of the supporting ropes 30 during the lifetime of the construction work, if needed.

Such a replacement phase may be performed as follows:

- the old rope 30 to be replaced is disconnected from its anchorage 60;
- its upper end is coupled to the lower end of a new rope having first connector parts 32A distributed at the prescribed locations along its length;
- the lower end the old rope is pulled to remove it while installing the new rope;
- the upper end of the new rope adjacent is connected in place of the old rope.

The connectors 32 that were formed by associating first connector parts 32A secured to the old rope with pawl boxes 32B/C of the sheath segments 21 disappear in the replacement phase as the first connector parts 32A of the old rope travel through the pawl boxes 32B/C while the lower end the old rope is pulled. Instead, new connectors 32 are formed by associating the first connector parts 32A secured to the new rope with the pawl boxes 32B/C of the sheath segments 21 after the first connector parts 32A of the new rope have travelled through the pawl boxes 32B/C when the new rope has been pulled all the way down.

It will be appreciated that the embodiments described above are illustrative of the invention disclosed herein and that various modifications can be made without departing from the scope as defined in the appended claims.

For example, the invention is applicable to structural cables other than stay cables.

The invention claimed is:

1. A sheath for a structural cable of a construction work, the structural cable having a path between an upper anchorage and a lower anchorage, the sheath comprising:

sheath segments assembled along the path of the structural cable;

wherein connectors are configured to block relative upward movement of at least one supporting rope with respect to the sheath segments and to allow relative downward movement of the at least one supporting rope with respect to the sheath segments.

2. The sheath as claimed in claim 1, wherein the at least one supporting rope and the connectors are located inside the sheath segments.

3. The sheath as claimed in claim 1 wherein the sheath segments are connected to the at least one supporting rope independently of each other by the connectors.

4. The sheath as claimed in claim 3, wherein a telescopic coupling is provided between a first sheath segment and a second sheath segment assembled next to the first sheath segment along the path of the structural cable, wherein the telescopic coupling comprises a first sleeve portion belonging to the first sheath segment and a second sleeve portion belonging to the second sheath segment and inserted into the first sleeve portion, and wherein at least one of the connectors has a connector part secured to the first sheath segment at an inner surface of the first sleeve portion so as to receive a respective supporting rope.

5. The sheath as claimed in claim 4, wherein a plurality of the connectors have respective connector parts mounted on a collar fixed inside the first sleeve portion so as to receive a respective supporting rope extending through the first and second sheath segments.

6. The sheath as claimed in claim 4, wherein the first sleeve portion has a same outer cross-section as main portions of the first and second sheath segments.

7. The sheath as claimed in claim 1, wherein each of the sheath segments has a duct in which at least one longitudinal channel is formed for housing the at least one supporting rope, and wherein the channel is separated by a wall from a main space of the duct provided for receiving load-bearing tendons of the structural cable.

8. The sheath as claimed in claim 7, wherein at least one supporting rope housed in the channel has connector parts of the connectors secured thereto at discrete locations, and wherein the channel has a cross-section sufficient for allowing longitudinal movement of the connector parts secured to the supporting rope housed therein.

9. The sheath as claimed in claim 7, wherein a telescopic coupling is provided between a first sheath segment and a second sheath segment assembled next to the first sheath segment along the path of the structural cable, wherein the telescopic coupling comprises a first sleeve portion belonging to the first sheath segment as an extension of the duct of the first sheath segment and a second sleeve portion belonging to the second sheath segment as an extension of the duct of the second sheath segment and inserted into the first sleeve portion, and wherein the channel formed in the duct of the second sheath segment is extended in the second sleeve portion in alignment with the channel formed in the duct of the first sheath segment.

10. The sheath as claimed in claim 1, wherein each of the connectors has a first connector part secured to a supporting rope, a second connector part secured to a sheath segment and a third connector part configured to block relative upward movement of the first connector part with respect to the second connector part and to allow relative downward movement of the first connector part with respect to the second connector part.

11. A structural cable of a construction work, comprising:

an upper anchorage;

a lower anchorage;

load-bearing tendons extending along a path of the structural cable between the upper and lower anchorages; and a sheath in which the load-bearing tendons are housed, wherein the sheath comprises:

sheath segments assembled along the path of the structural cable;

at least one supporting rope extending along the sheath segments and having an upper end connected to the construction work adjacent to the upper anchorage; and connectors for connecting the sheath segments to the at least one supporting rope, wherein the connectors are configured to block relative upward movement of the at least one supporting rope with respect to the sheath segments and to allow relative downward movement of the at least one supporting rope with respect to the sheath segments.

12. A method of installing a sheath for a structural cable of a construction work, the structural cable having a path between an upper anchorage and a lower anchorage, the sheath having a number N of sheath segments, the method comprising:

mounting at least one supporting rope with an upper end adjacent to the upper anchorage;

for each integer n such that $1 \leq n \leq N$:

inserting the at least one supporting rope into the n-th sheath segment;

connecting the n-th sheath segment to a supporting rope; and lifting first to n-th sheath segments along the at least one supporting rope, wherein connectors are provided to block relative upward movement of the at least one supporting rope with respect to the sheath segments and to allow relative downward movement of the at least one supporting rope with respect to the sheath segments.

13. The method as claimed in claim 12, wherein each supporting rope has first connector parts secured thereto at discrete locations, wherein each sheath segment has at least one second connector part secured thereto, and wherein each of the connectors is formed by associating a first connector part secured to a supporting rope, a second connector part secured to a sheath segment and a third connector part configured to block relative upward movement of the first connector part with respect to the second connector part and to allow relative downward movement of the first connector part with respect to the second connector part.

14. The method as claimed in claim 13, wherein connecting the n-th sheath segment to a supporting rope for an integer n such that $1 \leq n \leq N$ comprises forming at least one connector by associating a first connector part secured at a lowermost discrete location of a respective supporting rope, a second connector part secured to the n-th sheath segment and a third connector part.

15. The method as claimed in claim 14, wherein lifting the sheath segments for an integer n such that $1 < n \leq N$ comprises forming at least $n-1$ connectors by associating, for each integer j such that $1 < j < n$, a first connector part secured to a supporting rope at a $(n-j+1)$-th discrete location, starting from the lowermost discrete location, a second connector part secured to the j-th sheath segment and a third connector part.

16. The method as claimed in claim 15, comprising:

lowering the supporting rope while preventing downward movement of at least the $(n-1)$-th sheath segment;

inserting the at least one supporting rope into the n-th sheath segment;

forming an n-th connector by associating the first connector part secured at the lowermost discrete location of the supporting rope, a second connector part secured to the n-th sheath segment and a third connector part; and pulling back up the supporting rope, thereby forming the at least $n-1$ connectors.

17. The method as claimed in claim 16, wherein supporting ropes mounted with respective upper ends adjacent to the upper anchorage comprise:

an active rope that is lowered and pulled back up; and a static rope used to prevent downward movement of the sheath segments when the active rope is lowered and pulled back up, and wherein the sheath segments have second connector parts arranged to form connectors with first connector parts secured to the active rope and additional second connector parts arranged to form connectors with first connector parts secured to the static rope.

18. The method as claimed in claim 12, wherein the sheath segments are assembled before installation of load-bearing tendons of the structural cable.

19. The method as claimed in claim 18, wherein the sheath segments have an integral cross-section, and wherein, for each integer n such that $1<n\leq N$, the steps of inserting the at least one supporting rope into the n-th sheath segment and forming the n-th connector are performed while holding the (n−1)-th sheath segment to restrict lateral movements thereof.

20. The method as claimed in claim 19, wherein, for each integer n such that $1<n\leq N$, the step of lifting the first to n-th sheath segments is performed at least in part while tensioning at least one supporting rope to restrict lateral movements of the sheath segments.

21. A maintenance method for a structural cable of a construction work, the structural cable comprising:

an upper anchorage;

a lower anchorage;

load-bearing tendons extending along a path of the structural cable between the upper and lower anchorages; and a sheath in which the load-bearing tendons are housed, wherein the sheath comprises:

sheath segments assembled around the load-bearing tendons along the path of the structural cable;

at least two supporting ropes extending along the sheath segments, each having an upper end connected to the construction work adjacent to the upper anchorage; and connectors for connecting the sheath segments to the at least one supporting rope, wherein the connectors are arranged to block relative upward movement of the at least one supporting rope with respect to the sheath segments and to allow relative downward movement of the at least one supporting rope with respect to the sheath segments, the maintenance method comprising replacing a first one of the supporting ropes by a second supporting rope while the assembled sheath segments are supported by at least another one of the supporting ropes, wherein replacing the first supporting rope by the second supporting rope comprises:

disconnecting an upper end of the first supporting rope;

coupling a lower end of the second supporting rope to the upper end of the first supporting rope;

pulling a lower end the first supporting rope to remove the first supporting rope while installing the second supporting rope; and connecting an upper end of the second supporting rope adjacent to the upper anchorage.

22. The maintenance method as claimed in claim 21, wherein each of the first and second supporting ropes has first connector parts secured thereto at discrete locations, wherein each sheath segment has second connector parts secured thereto, and wherein before replacing the first supporting rope by the second supporting rope, connectors are formed by associating a first connector part secured to the first supporting rope, a second connector part secured to a sheath segment and a third connector part configured to block relative upward movement of the first connector part with respect to the second connector part and to allow relative downward movement of the first connector part with respect to the second connector part, wherein after replacing the first supporting rope by the second supporting rope, new connectors are formed by associating a first connector part secured to the second supporting rope, a second connector part secured to a sheath segment and a third connector part configured to block relative upward movement of the first connector part with respect to the second connector part and to allow relative downward movement of the first connector part with respect to the second connector part, and wherein the first connector parts secured to the first and second supporting ropes travel through the second connector parts secured to the sheath segments when the lower end of the first supporting rope is pulled downward for replacing the first supporting rope by the second supporting rope.

* * * * *